US008916775B2

(12) United States Patent
Tamaki

(10) Patent No.: US 8,916,775 B2
(45) Date of Patent: Dec. 23, 2014

(54) SHIELDED CABLE

(75) Inventor: Hiroto Tamaki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 130 days.

(21) Appl. No.: 13/517,947

(22) PCT Filed: Dec. 28, 2010

(86) PCT No.: PCT/JP2010/007590

§ 371 (c)(1),
(2), (4) Date: Jun. 20, 2012

(87) PCT Pub. No.: WO2011/083557

PCT Pub. Date: Jul. 14, 2011

(65) Prior Publication Data

US 2012/0273248 A1 Nov. 1, 2012

(30) Foreign Application Priority Data

Jan. 6, 2010 (JP) ..... 2010-001263

(51) Int. Cl.
*H01B 7/00* (2006.01)
*H01B 11/10* (2006.01)
*H01B 13/26* (2006.01)

(52) U.S. Cl.
CPC ..... *H01B 11/1025* (2013.01); *H01B 11/1008* (2013.01); *H01B 13/26* (2013.01)
USPC ..... 174/102 R; 174/102 SP; 174/108; 174/109

(58) Field of Classification Search
USPC ..... 174/36, 102 R, 107, 108, 106 R, 110 R, 174/113 R
See application file for complete search history.

(56) References Cited

U.S. PATENT DOCUMENTS

| | | | | | |
|---|---|---|---|---|---|
| 2,447,168 | A | * | 8/1948 | John et al. | 174/105 SC |
| 3,474,186 | A | * | 10/1969 | Hale | 174/103 |
| 4,323,721 | A | * | 4/1982 | Kincaid et al. | 174/36 |
| 4,327,246 | A | * | 4/1982 | Kincaid | 174/36 |
| 4,477,693 | A | * | 10/1984 | Krabec et al. | 174/36 |
| 4,855,534 | A | * | 8/1989 | O'Connor | 174/36 |
| 4,898,640 | A | * | 2/1990 | O'Connor | 156/204 |

(Continued)

FOREIGN PATENT DOCUMENTS

| | | | | | |
|---|---|---|---|---|---|
| CN | 201027040 | Y | | 2/2008 | |
| CN | 201364751 | Y | | 12/2009 | |
| DE | 101 01 051 | C2 | * | 8/2001 | H01B 11/10 |
| JP | 54-072676 | U | | 5/1979 | |
| JP | 58-020423 | U | | 2/1983 | |
| JP | 58174811 | U | | 11/1983 | |

(Continued)

*Primary Examiner* — William H Mayo, III
(74) *Attorney, Agent, or Firm* — Canon USA, Inc., IP Division

(57) ABSTRACT

A shielded cable includes at least one electric wire and a shielding layer covering the electric wire, which is formed by helically winding a tape-shaped shield member. The shielding layer is formed by winding the tape-shaped shield member laminating and integrating an insulating layer and a metal layer such that one side end portions along a lengthwise direction overlap with each other to form an overlapping portion and a non-overlapping portion of the shield member. A first one side end portion forming the overlapping portion is a folding portion formed by folding the insulating layer inward, and a second one side end portion forming the non-overlapping portion is a non-folding portion that is not folded. In the overlapping portion, the metal layer at the folding portion and the metal layer at the non-folding portion are electrically connected. The shielding layer has notches formed along the second one side end portion.

4 Claims, 8 Drawing Sheets

(56) References Cited

U.S. PATENT DOCUMENTS

| | | | | | |
|---|---|---|---|---|---|
| 5,023,395 | A | * | 6/1991 | O'Connor | 174/36 |
| 5,053,582 | A | * | 10/1991 | Terakawa et al. | 174/36 |
| 5,945,764 | A | * | 8/1999 | Bendfeld | 310/196 |
| 6,664,466 | B2 | * | 12/2003 | Bailey | 174/36 |
| 2010/0108350 | A1 | | 5/2010 | Cases | |

FOREIGN PATENT DOCUMENTS

| | | | | | |
|---|---|---|---|---|---|
| JP | 60-192318 | U | | 12/1985 | |
| JP | 61011221 | U | | 1/1986 | |
| JP | 2002-075076 | A | | 3/2002 | |
| JP | 2007-027050 | A | | 2/2007 | |
| WO | WO 2005/055251 | A1 | * | 6/2005 | H01B 11/06 |

* cited by examiner

SHIELDED CABLE

CROSS REFERENCE TO RELATED APPLICATIONS

This application is a National Stage filing of PCT application No. PCT/JP2010/007590, filed Dec. 28, 2010, which claims priority from Japanese Patent Application No. 2010-001263, filed Jan. 6, 2010, all of which are hereby incorporated by reference herein in their entirety.

TECHNICAL FIELD

The present invention relates to a shielded cable used for wiring electrical and electronic devices and control devices.

BACKGROUND ART

In digital signal processing apparatuses, signal processing speed has been speeding up, and ensuring signal quality and reducing radiation noise are both desired. Especially, in outside wiring of digital devices for transmitting signals between the devices, the transmission distances are often long. In such a case, it is difficult to install a metal housing that serves as a stable ground in the vicinity of a signal wire. Accordingly, the achievement of both ensuring signal quality and reducing radiation noise is highly required. Further, even in wiring inside the digital devices, it is difficult to reduce radiation noise by using its housing since the recent housing is often non-conductive. Further, when a signal is transmitted and received between a digital device and a movable member, for example, in a digital multifunctional device, stable transmission between an image reading device and an image signal processing device is difficult since the image reading device is moving and the positional relationship of the cable to the metal housing is not fixed. To solve the problems, a shielded cable is often used in the wiring outside the digital devices, in the wiring within the digital devices that require high-speed signal transmission, or in the signal communication with movable members. By using the shielded cable, superimposition of radiation noise from outside on a communication signal flowing in a signal wire provided inside the shielded cable can be prevented. Further, reduction of radiation noise to the outside can be expected. Moreover, the coupling between the shielding layer and the signal wire is strong, and the shield member serves as a stable signal ground. Accordingly, increase of the signal quality can be expected.

Conventionally, a shielded cable is known that has a shielding layer formed by helically winding a tape-shaped shield member of a metal layer such as aluminum or copper and an insulating layer such as a plastic film laminated and integrated onto a signal wire to cover the signal wire. The shielded cable formed by helically winding the tape-shaped shield member has the simple structure. Accordingly, as compared to a shielded cable formed by braiding a wire, the productivity of the shield cable is higher. Moreover, the tape-shaped shield member can be tightly wound onto the signal wire. Accordingly, the shield member serves as a stable signal ground.

However, it is known that the radiation noise reduction effect of the shielded cable formed by winding the tape-shaped shield member is lower than that of the braided shielded cable. The reasons of the low radiation noise reduction effect of the shielded cable formed by winding the tape-shaped shield member are as follows. In order to obtain a sufficient radiation noise reduction effect in a frequency band of 30 MHz or more, the thickness of the metal layer covering the signal wire should be about several tens of micrometers.

However, in a step for winding the tape-shaped shield member at the time of manufacturing the cable, tension is applied to the shield member. In order to prevent the metal layer from being fractured by the tension, it is necessary to use a shield member of a plastic film of, for example, polyethylene terephthalate (PET) that has large tensile stress and is laminated by a metal layer such as aluminum or copper. In this structure, in an overlapping portion of the shield member, the insulating layer is sandwiched between the metal layers. Accordingly, the metal layers of the wound shield member are not in contact with each other. Thus, the conduction is generated only in the winding direction of the tape-shaped shield member. More specifically, in a high-frequency band, the insulating layer sandwiched between the metal layers in the overlapping portion of the shield member functions as a shield opening in a direction preventing the flow of a return current flowing in the shield member (shielding layer), which reduces the radiation noise suppression effect. To solve the problem, Japanese Patent Application Laid-Open No. 2002-75076 proposes a shielded cable formed of double shielding layers inside and outside by doubly winding the above-described tape-shaped shield member such that the metal layers face each other and come in contact with each other.

However, since the above-described known shielded cable has the double shield structure formed by doubly winding the tape-shaped shield member such that the metal layers face each other and come in contact with each other, there are the following problems. Since the shield member is to be doubly wound, the amount used for the tape-shaped shield member is about twice as much as the amount used for a single shield member, the cost is increased. Moreover, the diameter of the cable is larger than that of the single cable. Accordingly, wiring of the cable in a narrow space is difficult. Further, the flexibility of the cable is low, and wiring performance also becomes low.

CITATION LIST

Patent Literature

PTL 1: Japanese Patent Application Laid-Open No. 2002-75076

SUMMARY OF INVENTION

The present invention is directed to a shielded cable achieving effective shield performance with a shielding layer while costs are reduced and decrease in wiring performance is prevented.

According to an aspect of the present invention, a shielded cable includes at least one electric wire, and a shielding layer covering the electric wire, which is formed by helically winging a tape-shaped shield member. The shielding layer is formed by winding the tape-shaped shield member laminating and integrating an insulating layer and a metal layer such that one side end portions along a lengthwise direction overlap with each other to form an overlapping portion and a non-overlapping portion of the shield member. The one side end portion of the tape-shaped shield member forming the overlapping portion is a folding portion formed by folding the insulating layer inward, and the other side end portion forming the non-overlapping portion is a non-folding portion that is not folded. In the overlapping portion, the metal layer at the folding portion and the metal layer at the non-folding portion are electrically connected with each other.

Further features and aspects of the present invention will become apparent from the following detailed description of exemplary embodiments with reference to the attached drawings.

BRIEF DESCRIPTION OF DRAWINGS

The accompanying drawings, which are incorporated in and constitute a part of the specification, illustrate exemplary embodiments, features, and aspects of the invention and, together with the description, serve to explain the principles of the invention.

DESCRIPTION OF EMBODIMENTS

Various exemplary embodiments, features, and aspects of the invention will be described in detail below with reference to the drawings.

Figure 1A:
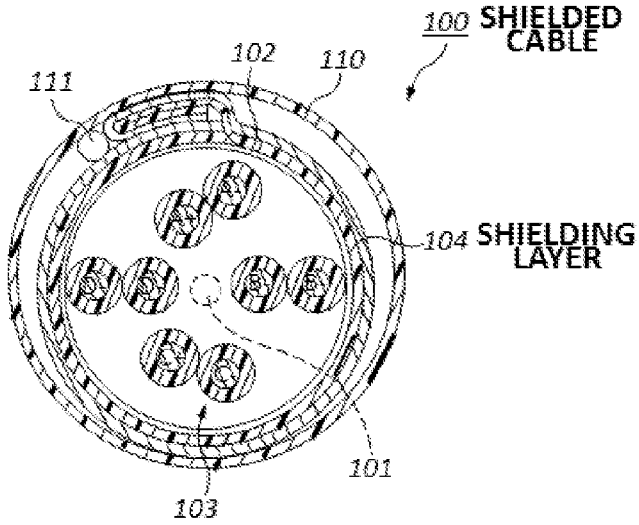
FIG. 1A is a cross-sectional view of a shielded cable.
Figure 1B:
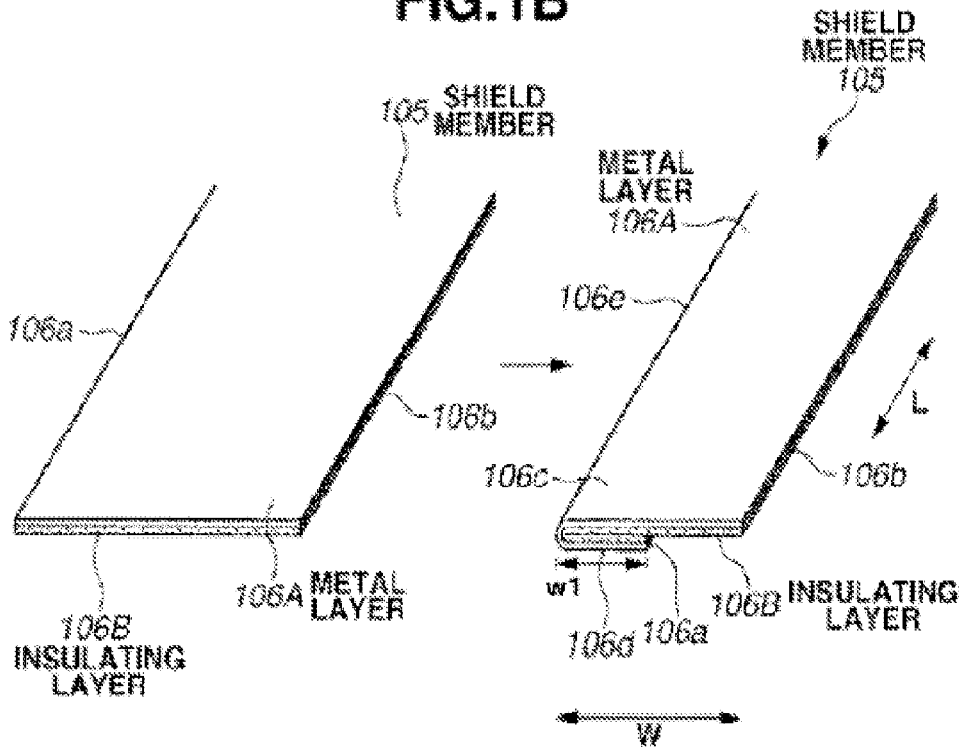
FIG. 1B illustrates manufacturing steps of the shielded cable according to a first exemplary embodiment.

FIGS. 1A and 1B illustrate a schematic structure of a shielded cable according to a first exemplary embodiment of the present invention. As shown in FIG. 1A, a shielded cable 100 has at least one signal wire as an electric wire formed by covering a conductor with an insulating member. In the first exemplary embodiment, four pairs of twisted pair wires having two signal wires are provided. More specifically, the shielded cable includes a twisted pair wire having a signal wire A+ and a signal wire A−, a twisted pair wire having a signal wire B+ and a signal wire B−, a twisted pair wire having a signal wire C+ and a signal wire C−, and a twisted pair wire having a signal wire D+ and a signal wire D−. Each twisted pair wire is used for transmitting a digital signal. A conductor used for the signal wires A+, A−, B+, B−, C+, C−, D+, and D− is, for example, a tinned annealed copper wire. In the first exemplary embodiment, a plurality of signal wires and a plurality of twisted pair wires are provided. However. the present invention is not limited to the above case. A single wire can also be used. Moreover, the electric wire is not limited to the signal wire. The present invention can also be applied to a core wire for supplying electric power. In other words, one or more electric wires are to be used.

These signal wires are arranged around a threadlike intervening member 101 serving as a center. The signal wires are assembled together into one bundle using a holding winding member 102. Hereinafter, the bundle of the signal wires is referred to as a signal wire bundle 103. By bundling the signal wires together into one as the signal wire bundle 103 using the holding winding member 102, the mechanical strength of the cable can be increased and it is possible to make the cable's cross-sectional shape round. The intervening member 101 is, for example, cotton yarn. The holding winding member 102 is, for example, plastic tape, cotton cloth, or the like. Preferably, the intervening member 101 has a shape which enables fixing of positional relationship of each signal wire such that crosstalk between each line is to be reduced. However, the shape is not limited to a specific shape.

The shielded cable 100 includes a shielding layer 104 formed on the outside of the signal wire bundle 103. The shielding layer 104 is formed by helically winding a tape-shaped shield member. The outer surface of the tape-shaped shield member is covered with a heat-shrinkable insulating member 110 of, for example, polyethylene as electric insulation. To the insulating member 110, a normally used compounding agent such as an anti-aging agent, an antioxidant, a stabilizing agent, and a flame retardant can be added.

As shown in FIG. 1B, a shield member 105 is formed in a tape-shape by laminating and integrating a metal layer 106A formed of a metal foil such as aluminum or copper and an insulating layer 106B formed of a resin having insulation properties such as a polymer base resin. A side end portion 106*a*, which is one of side end portions along a lengthwise direction L, of the tape-shaped shield member 105 forms a folding portion 106*d* of a width W1 by folding the tape-shaped shield member 105 in two with the insulating layer 106B inside and the metal layer 106A outside. A side end portion 106*b*, which is the other portion along the lengthwise direction L, of the tape-shaped shield member 105 is not folded and forms a non-folding portion 106*c*.

Figure 2A:
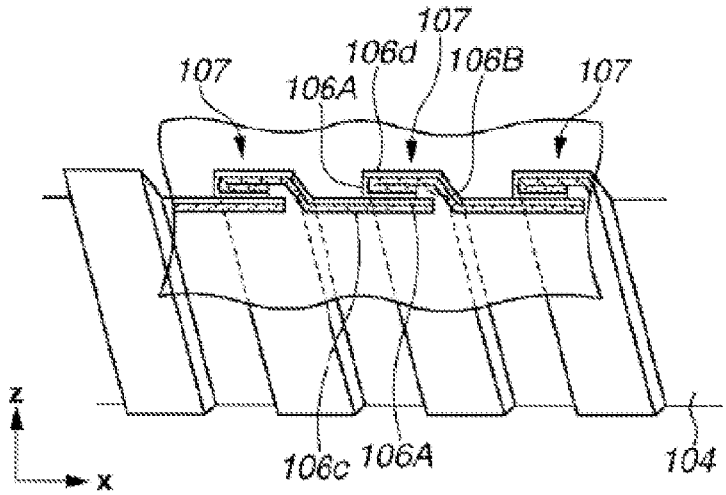
FIG. 2A is a front view illustrating a schematic structure of the shielded cable according to the first exemplary embodiment.
Figure 2B:
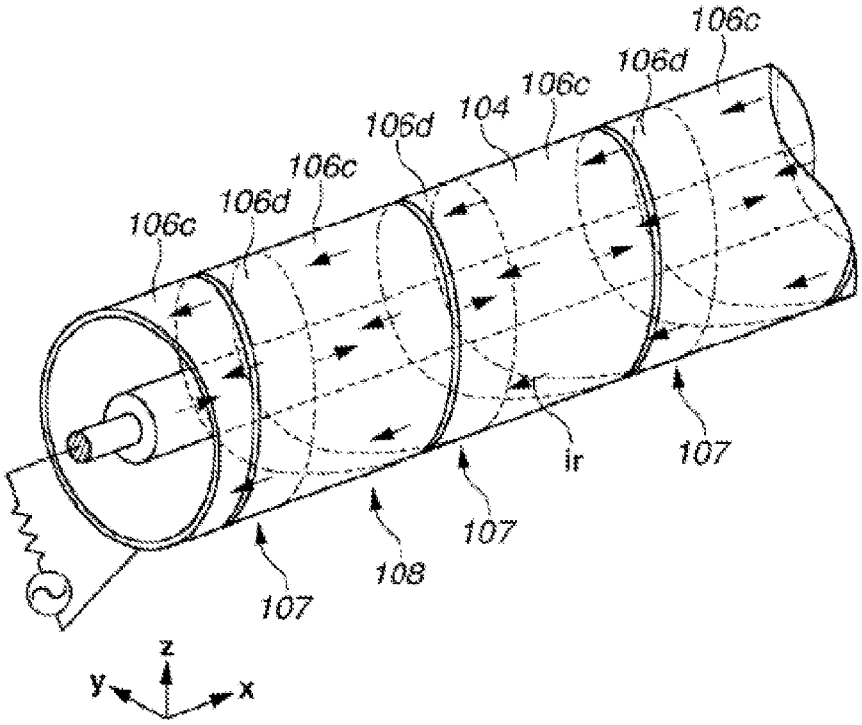
FIG. 2B is a perspective view illustrating a schematic structure of the shielded cable according to the first exemplary embodiment.

As shown in FIGS. 2A and 2B, the shielding layer 104 is helically wound such that the one side end portions 106*a* overlap with each other because the tape-shaped shield member 105 covers the signal wire bundle (signal wire) 103. In the structure, on the shielding layer 104, an overlapping portion 107 and a non-overlapping portion 108 are formed.

In the overlapping portion 107, the metal layer 106A at the non-folding portion 106*c* and the metal layer 106A at the folding portion 106*d* come in contact with each other to conduct electricity. The width w1 (see FIG. 1B) of the folding portion 106*d* of the tape-shaped shield member 105 is to be wound such that the metal layers come in contact with each other at the overlapping portion 107, and the width w1 is not limited to a specific width. The metal layer 106A serves as a ground for the signal wire. Accordingly, the metal layer 106A not only reduces radiation of noise but flows a return current.

According to the first exemplary embodiment, only by forming the shield member 105 having the simple structure of folding the base material 106, it is possible to eliminate an slot of the shield due to the insulating layer 106B. Accordingly, it is not necessary to add a new member to conduct electricity between the metal layers, and conduction by the metal layer 106A can be ensured over the entire outer circumference of the signal wire bundle 103. Thus, as shown in FIG. 2B, a return current ir of the metal layer 106A smoothly flows in a direction of the axis of the cable (in FIG. 2B, x-axis direction). By bringing the metal layer 106A of the folding portion 106*d* into contact with the metal layer 106A of the non-folding portion 106*c* in the overlapping portion 107, without preventing the flow of the return current ir, sufficient radiation noise reduction effect, that is, a shield performance can be achieved. Moreover, as compared to the case that the shield member is doubly wound onto the signal wire bundle 103, the amount used for the tape-shaped shield member 105 can be reduced. Accordingly, the cost can be reduced. Further, the diameter of the cable can be reduced, and the wiring performance can be increased.

Depending on the way of winding, the tape-shaped shield member 105 can be wound to make either one of the metal layer 106A and the insulating layer 106B an outside layer. The winding method can be freely selected depending on the environment of the use. In the first exemplary embodiment, the shield member 105 is wound around the signal wire bundle 103, with the non-folding portion 106*c* as the inside, and the folding portion 106*d* as the outside such that, relative to the signal wire bundle 103, the metal layer 106A at the non-folding portion 106*c* faces the outside. By the winding method, the outer surface of the shielding layer 104 becomes the metal layer 106A.

On the metal layer 106A that becomes the outer surface of the shielding layer 104, a drain wire 111 extending along the signal wire in the x-axis direction is provided in contact with the metal layer 106A. The drain wire 111 is pressed to the metal layer 106A by the heat-shrinkable insulating member 110, and good conductive state between the drain wire 111 and the metal layer 106A is ensured. The drain wire 111 is an end portion of the shielded cable 100, and used to ease connection operation of the metal layer 106A and a ground terminal of a connector. However, if the contact between the metal layer of the outer surface of the shielding layer 104 and the metal member of the connector that is electrically continuous the ground is ensured, it is not necessary to use the drain wire 111.

The insulating. member 110 covers the outer surface of the shielding layer 104. Accordingly, in the overlapping portion 107, the metal layer 106A at the non-folding portion 106*c* that is arranged outside, presses and contacts with the metal layer 106A at the folding portion 106*d* that is arranged inside. Thus, the contact performance of the metal layers increases and good conduction is ensured. Accordingly, radiation noise reduction effect can be more surely achieved. Moreover, by covering the shielding layer 104 with the insulating member 110, it is possible to prevent the overlapping portion 107 from generating a gap when the cable is bent, and the radiation noise reduction effect can be ensured. Further, invasion of dusts or the like can be prevented and water-tightness and mechanical strength can be increased. Moreover, electric insulation against the outside of the cable can be achieved.

Moreover, when the shielded cable is used as an interface cable to connect the digital device outside, if the shielding layer is required to have mechanical strength, a shielding layer formed by a braided shield or a served shield of wires can be newly added. In such a case, both of the radiation noise reduction effect and the mechanical strength of the shielding layer can be increased.

Figure 3A:
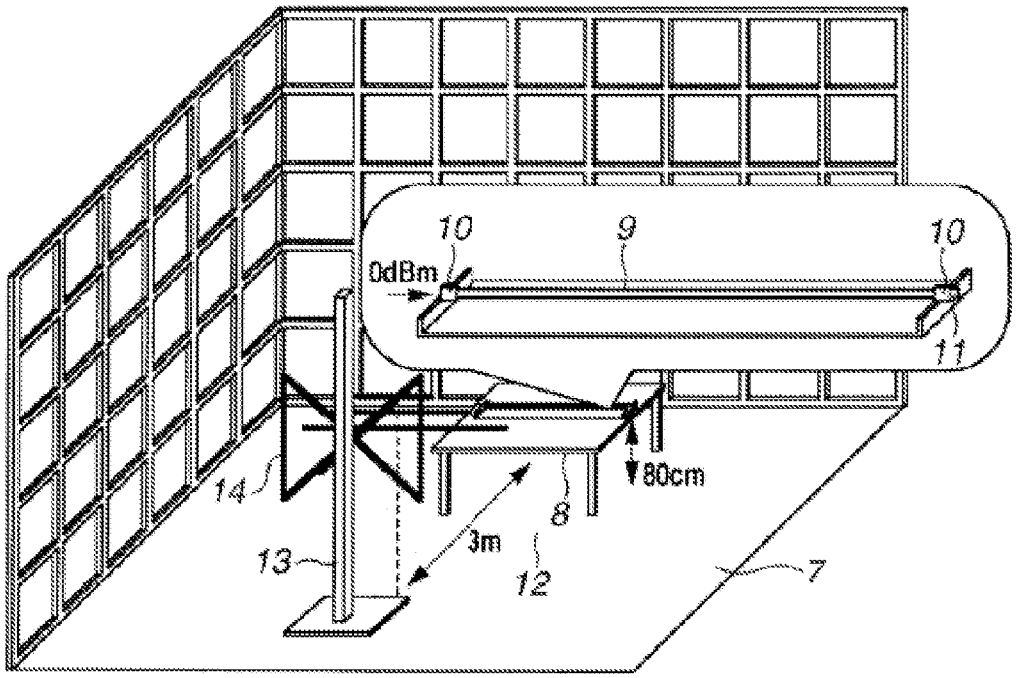
FIG. 3A illustrates a measuring environment for measuring radiation noise of the shielded cable.

Next, an evaluation of the radiation noise reduction effect of the shielded cable 100 was performed. The evaluation method of the radiation noise reduction effect of the shielded cable 100 includes a surface transfer impedance method, an absorption clamp method, a line injection method, and the like. In the first exemplary embodiment, in a semi-anechoic chamber, radiation noises that leaked from the shielded cable 100 were measured and evaluated. FIG. 3A illustrates a state the radiation noises were being measured. First, a setup for the measurement is described. In a semi-anechoic chamber 7, a wooden measurement table 8 was placed at a position 80 cm from the metal surface. On the table 8, a metal plate of 160 cm×80 cm was placed. At a position five centimeters above the metal plate, a measurement sample 9 held by polystyrene foam was placed. The measurement sample 9 is a shielded cable formed by winding the shielded cable 100, a braided shielded cable, and a conventional tape-shaped shield formed of a polyethylene resin and aluminum foil without bending them. To both ends portions of the measurement sample 9, N connectors 10 formed by soldering internal signal wires together were connected. Further, to one of the end portions, a comb generator developed by York EMC Services Ltd was connected. The other end portion is terminated by a terminator of 50 ohm. Under the environment, conditions for the measurement sample 9 were set as follows. Except the difference between the structures of the shielding layers, all of the state of the internal signal wire, the connection state of both end portions, the sheath member, the cable installation position, and the like were under the same conditions. The cable length was one meter. A turntable 12 was placed right under a central part of the cable. At a position away from the central part by three meters, a wideband log periodic antenna as a measurement antenna 14 and an antenna mast 13 for supporting the antenna were arranged such that a power supplying part of the antenna is arranged at the position three meters from a center. The measurement antenna 14 was connected to an EMI receiver developed by Rohde & Schwarz in a measurement room (not shown) that is a room next door, by a coaxial cable.

Next, the measurement method is described. Power was supplied to the signal wire inside the shielding layer with the comb generator connected to one end of the measurement sample 9 as an excitation source. While the turntable 12 was turned 360 degrees, and the position of the measurement antenna 14 was changed from one meter to four meters from the metal surface meter by meter, an electric field that leaked from the shielding layer was monitored with the receiver, and radiation electric field intensity was measured while a maximum value was held.

Figure 3B:
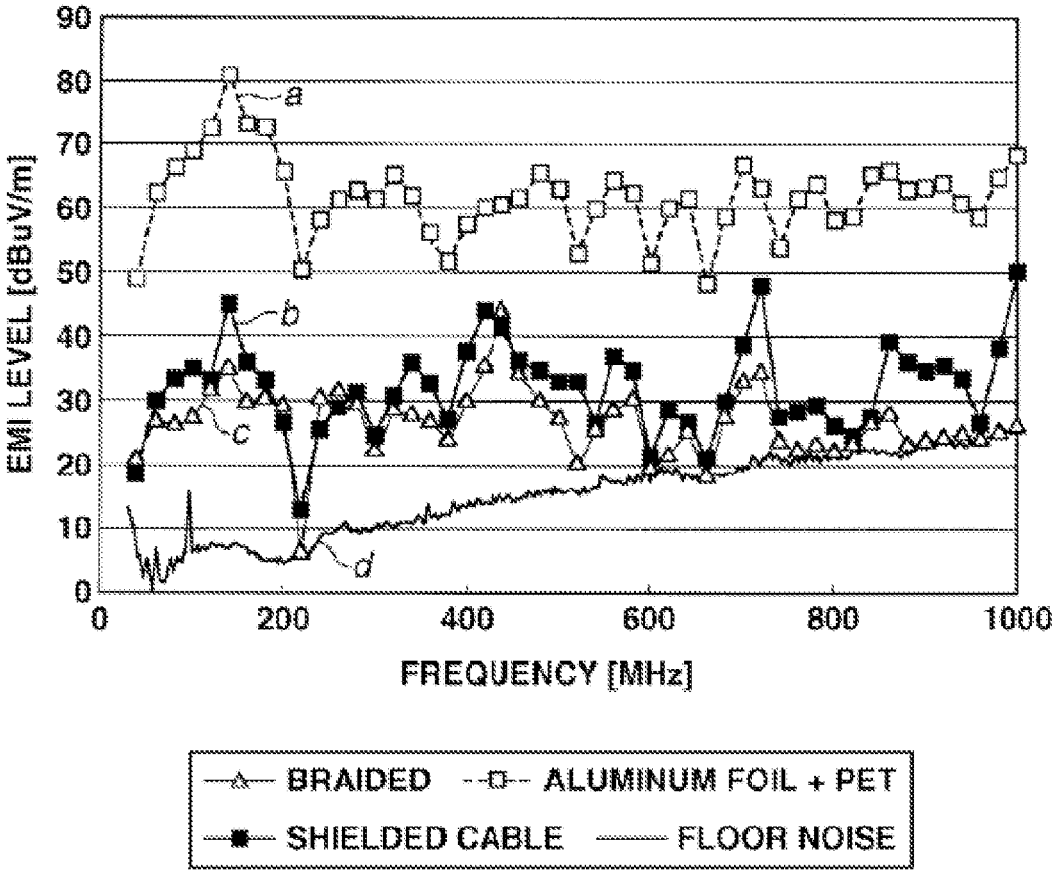
FIG. 3B illustrates results of the measurement.

The measurement results are shown in FIG. 3B. In FIG. 3B, a line made by connecting measurement points of white squares with broken lines shows a measurement result a of a shielded cable using a conventional shield member that is not folding-processed, with the horizontal axis as frequency and the vertical axis as electric field intensity. A line made by connecting measurement points of black squares with solid lines shows a measurement result b of the shielded cable 100 according to the first exemplary embodiment. A line made by connecting measurement points of white triangles with solid lines shows a measurement result c of a braided shielded cable. A line of only a solid line shows a measurement result d of floor noises indicating measurement limits. As shown in FIG. 3B, we found that as compared to the shielded cable formed by helically winding the shield member that is not folding-processed, the radiation noise of the shielded cable 100 according to the first exemplary embodiment decreased about 30 dB at a maximum. We also found that the shielded cable 100 has improved radiation noise reduction effect to a level similar to that of the braided shielded cable.

A shielded cable 100A according to a second exemplary embodiment is described with reference to FIGS. 4A and 4B. As to structures similar to that in the first exemplary embodiment, same reference numerals are applied, and their descriptions are omitted. The tape-shaped shield member 105 described in the first exemplary embodiment can also be wound in a way opposite to the winding method according to the first exemplary embodiment such that the metal layer 106A faces the inside of the cable. More specifically, depending on the way of winding, the shield member 105 can be wound make either one of the metal layer 106A and the insulating layer 106B the outside layer. Thus, the winding method can be freely selected depending on the environment of the use.

Figure 4A:
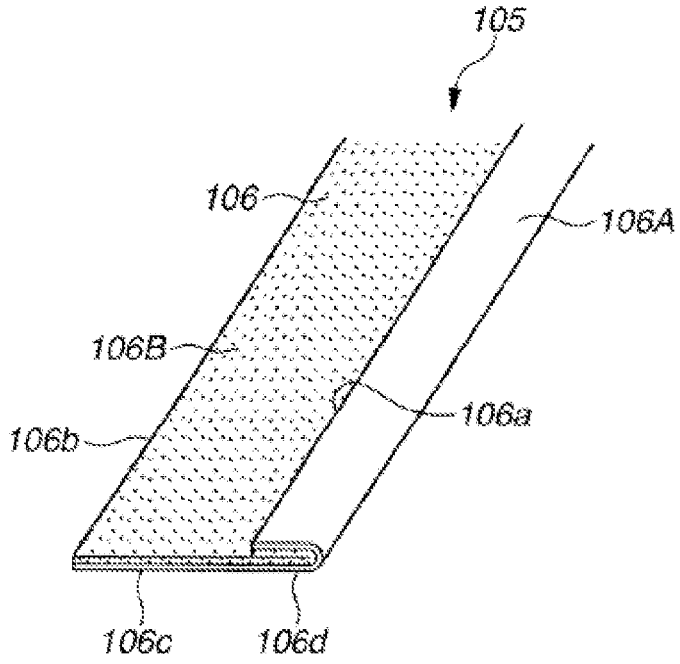
FIG. 4A is a perspective view of a shielded cable.

As shown in FIG. 4A, in the second exemplary embodiment, the shielded cable 100A has the shield member 105 similar to that in the first exemplary embodiment. However, the winding method is different. The shield member 105 shown in FIG. 4A is the shield member 105 shown in FIG. 1B viewed from a different angle.

Figure 4B:
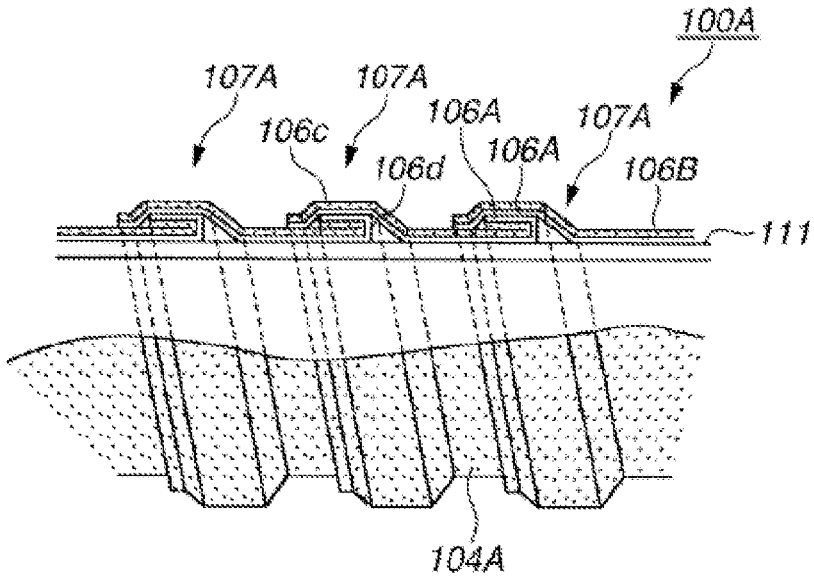
FIG. 4B is a front view of the shielded cable according to a second exemplary embodiment.

As shown in FIG. 4B, the shield member 105 is helically wound and has an overlapping portion 107A on the signal wire bundle. In the overlapping portion 107A, the metal layer 106A at the non-folding portion 106*c* comes in contact with the metal layer 106A at the folding portion 106*d*. In the second exemplary embodiment, the shield member 105 is wound around the signal wire bundle such that, around the signal wire bundle 103, the insulating layer 106B at the non-folding portion 106*c* faces the outside by folding the folding portion 106*d* to the inside, and the non-folding portion 106*c* to the outside. By the winding method, the outer surface of the shielding layer 104A becomes the insulating layer 106B.

On the metal layer 106A that becomes the inner surface of the shielding layer 104A, the drain wire 111 extending along the signal wire is provided in contact with the metal layer 106A. The drain wire 111 is pressed against the metal layer 106A by winding the shield member 105 around the signal wires bundle, and good conductive state between the drain wire 111 and the metal layer 106A is ensured. The drain wire 111 is the end portion of the shielded cable 100, and used to ease connection operation of the metal layer 106A and the ground terminal of the connecter.

As described above, in the second exemplary embodiment, similarly to the first exemplary embodiment, the metal layer 106A at the folding portion 106*d* comes in contact with the metal layer 106A at the non-folding portion 106*c* in the overlapping portion 107A. Accordingly, conduction by the metal layer 106A can be ensured over the entire outer circumference of the signal wire bundle. Accordingly, a shield performance by the shield member 105 can be effectively achieved. Moreover, the shield member 105 is formed by simply folding the one side end portion 106*a* of the base material 106 having the metal layer 106A and the insulating layer 106B. Accordingly, the shield performance can be achieved with the simple structure. Moreover, as compared to the case that the shield member is doubly wound onto the signal wire bundle, the amount used for the shield member 105 can be reduced. Accordingly, the cost can be reduced. Further, the diameter of the cable can be reduced, and the wiring performance can be increased.

Further, according to the second exemplary embodiment, the shield member 105 is wound such that the insulating layer 106B is exposed to the outside and the metal layer 106A are not exposed to the outside. Thus, the insulating member 110 in the first exemplary embodiment can be omitted. Moreover, in order to increase the adhesiveness of the metal layers, the outer surface of the shielding layer 104A can be covered with a heat-shrinkable insulating member similar to that in the first exemplary embodiment.

A shielded cable 100B according to a third exemplary embodiment of the present invention is described with reference to FIGS. 5A and 5B. To structures similar to that in the first exemplary embodiment, same reference numerals are applied, and their descriptions are omitted. While in FIGS. 5A and 5B, the heat-shrinkable insulating member and the drain wire are omitted, the insulating member and the drain wire are arranged similarly to the first exemplary embodiment.

On a shielded cable formed by helically winding a tape-shaped shield member such that an overlapping portion is formed, a distortion is generated due to a difference of geometric paths of the shield member. In the third exemplary embodiment, as shown in FIG. 5A. a shield member 105B is formed such that along the other side end portion 106*b* of the width direction W of the base material 106, a plurality of notches 106*f* are formed at equal distances in the lengthwise direction L. As shown in FIG. 5B, the shield member 105B is wound around the signal wire bundle such that the notch 106*f* is pressed by the folding portion 106*d* in an overlapping portion 107B. More specifically, a belt portion 106*g* (see FIG. 5A) formed by the notch 106*f* is pressed by the folding portion 106*d*, and the adhesiveness of the metal layers in the overlapping portion 107B is not lost.

Figure 5A:
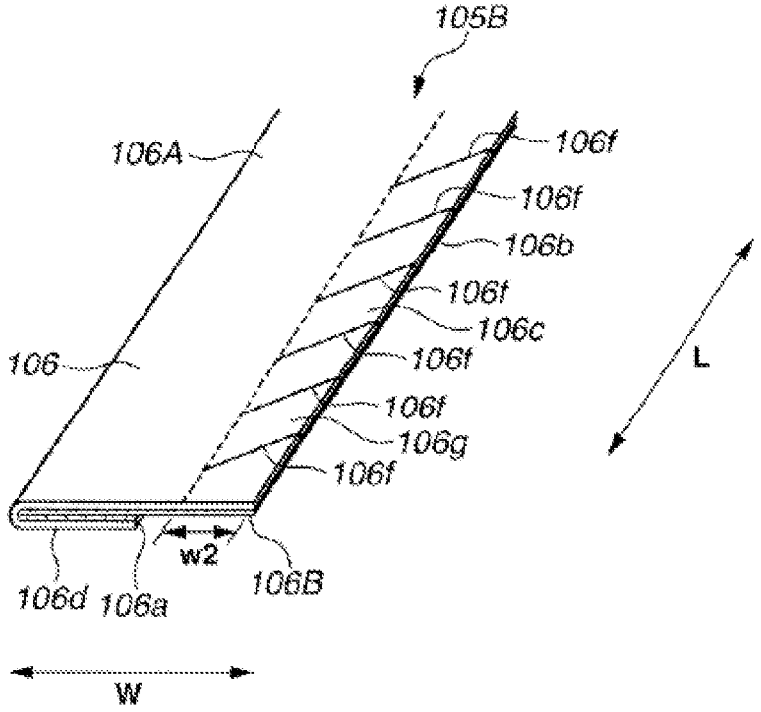
FIG. 5A is a perspective view of a shielded cable.
Figure 5B:
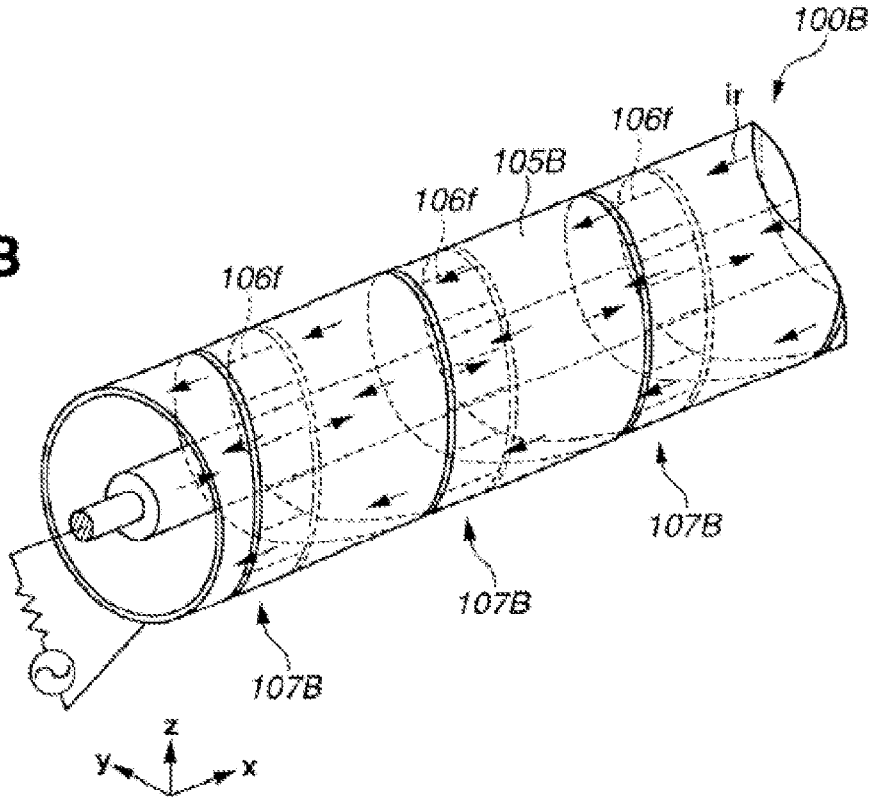
FIG. 5B is a front view of the shielded cable according to a third exemplary embodiment.

As shown in FIG. 5A, the notch 106*f* is formed such that the notch 106*f* is tilted to the end side of the other side end portion 106*b*. The inclination angle to the end side of the other side end portion 106*b* is set such that the shield member 105B is in parallel with the cable's axis direction (in FIG. 5B, x-axis direction) when the shield member 105B is wound around the signal wire bundle. The length w2 of the width direction W is set approximately to a length of the overlapping portion 107B shown in FIG. 5B. More specifically, the notch 106*f* is set to a length within the length of the overlapping portion 107B. The notch 106*f* can be formed not only along the other side end portion 106*b* of the width direction W of the base material 106, but also formed along the one side end portion 106*a*.

As described above, in the third exemplary embodiment, effects similar to those in the first exemplary embodiment can be obtained. Moreover, by providing the plurality of notches 106*f* along the other side end portion 106*b*, a concavo-convex shaped distortion generated due to a difference of the paths in winding can be absorbed. Accordingly, difficulty in winding can be reduced. Moreover, since the notches 106*f* are formed along the cable's axis direction (x-axis direction), the conduction in the axis direction is not lost, and the flow of the return current it is not prevented. Accordingly, leak and invasion of magnetic flux coming from a distortion can be prevented, and it is possible to minimize the decrease of the radiation noise reduction effect.

Preferably, the angle of the notch 106*f* to the other side end portion 106*b* is set such that the notch 106*f* is arranged in the cable's axis direction when the shield member 105B is wound. However, within the range in which the effects according to the third exemplary embodiment can be achieved, the notch 106*f* can be tilted to the cable's axis direction.

Figure 6:
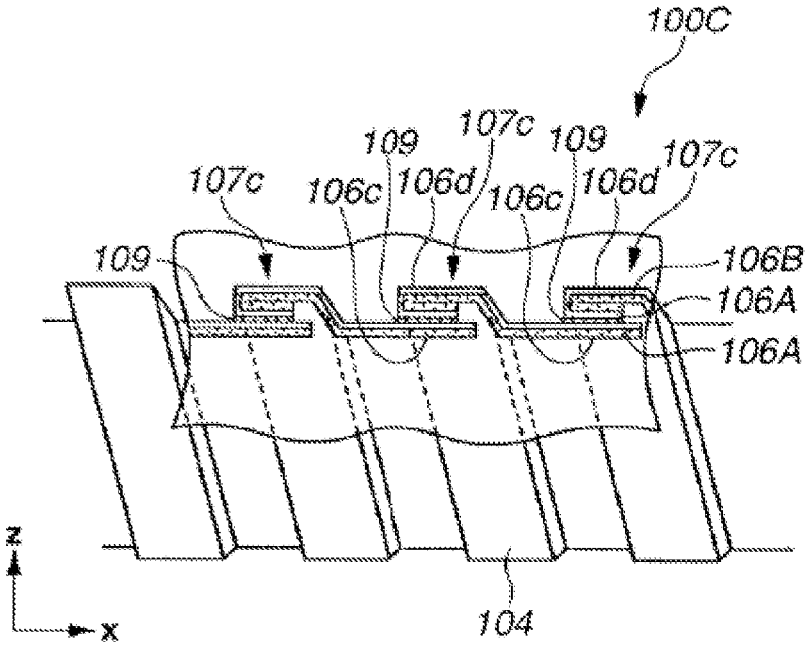
FIG. 6 is a front view illustrating a part of a shielded cable according to a fourth exemplary embodiment.

A shielded cable 100C according to a fourth exemplary embodiment is described with reference to FIG. 6. To structures similar to that in the first exemplary embodiment, same reference numerals are applied, and their descriptions are omitted. While in FIG. 6, the heat-shrinkable insulating member and the drain wire are omitted, the insulating member and the drain wire are arranged similarly to the first exemplary embodiment.

In the shielded cable 100C according to the fourth exemplary embodiment, in an overlapping portion 107C, the metal layer 106A at the non-folding portion 106*c* and the metal layer 106A at the folding portion 106*d* are bonded with a conductive adhesive 109. The conductive adhesive 109 is applied to one of the metal layer 106A, for example, the folding portion 106*d*, when the shield member 105 is wound. By bonding the metal layers with the conductive adhesive 109, it is possible to effectively prevent the generation of a gap between the shield members 105 when the cable is bent. Accordingly, the radiation noise reduction effect can be surely ensured.

A shielded cable 100D according to a fifth exemplary embodiment is described with reference to FIG. 7. To structures similar to that in the first exemplary embodiment, same reference numerals are applied, and their descriptions are omitted.

In the structure of a shielded cable employed in an Universal Serial Bus (USB) 3.0 and a category 7-compliant local area network (LAN) cable, around a multicore twisted pair signal wire, a tape-shaped shield member is wound. Further, the outside of the signal wires bundled together in one is covered with a braided shield, as a double shielded structure. Such a structure is employed to reduce capacitive crosstalk by providing a signal ground in the vicinity of each pair to perform stable signal transmission and reduce radiation noise on an outermost shielding layer.

Figure 7:
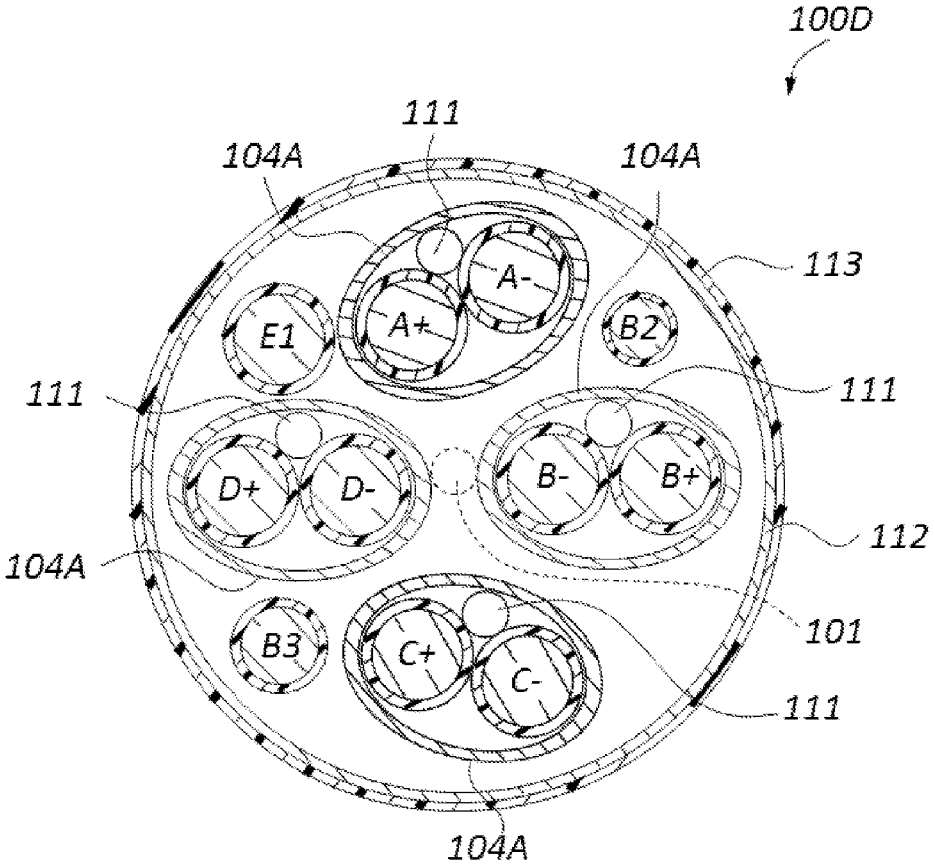
FIG. 7 is a cross-sectional view of a shielded cable according to a fifth exemplary embodiment.

For the purpose, as shown in FIG. 7, the shielded cable 100D according to the fifth exemplary embodiment is formed by winding the shield member described in the second exemplary embodiment such that the insulating layer is provided outside for each pair of the multicore twisted pair signal cables.

More specifically, a shielding layer 104A of a shield member is formed by helically winding the shield member on a twisted pair wire having the signal wires A+ and A− such that an overlapping portion is formed and metal layers of a folding portion and a non-folding portion come in contact with each other in the overlapping portion. Similarly, on each of a twisted pair wire having the signal wires B+ and B−, a twisted pair wire having the signal wires C+ and C−, a twisted pair wire having the signal wires D+ and D−, the shielding layer 104A is formed. In the twisted pair wire, the metal layer is provided inside, and the drain wire 111 is provided such that the drain wire comes in contact with the metal layer. In the fifth exemplary embodiment, on a core wire E1 for supplying electric power and low-speed signal wires E2 and E3, the shielding layer is not provided. However, on those wires, the shielding layer can be provided. These twisted pair wires, the core wire E1, and the signal wires E2 and E3 can be bundled in one and covered with a shielding layer 112 formed of a braided shield or the tape-shaped shield member 105 similar to that in the first exemplary embodiment. On the outside of the shielding layer 112, a heat-shrinkable insulating member 113 is covered.

As described above, in the fifth exemplary embodiment, the shielding layer 104A is formed on each twisted pair wire. Accordingly, the radiation noise reduction effect can be achieved on each twisted pair wire, and crosstalk can be reduced. Thus, both of stable signal transmission and further radiation noise reduction can be achieved.

On each twisted pair wire, the shield member can be wound such that the outer surface of the shielding layer is to be the metal layer. In such a case, if the outer surface of the shielding layer of each twisted pair wire is arranged such that the outer surface comes in contact with the metal layer of the outermost shielding layer 112, and the outermost shielding layer 112 is shorted to a stable ground, the drain wire 111 can be omitted.

The exemplary embodiments of the present invention have been described above. However, the present invention is not limited to the exemplary embodiments. In a shielded cable having a plurality of electric wires, each electric wire can be wound by the shield member. Moreover, in the plurality of electric wires, on only a specified or an arbitrary electric wire, the shield member can be wound. As to a shielded cable having only one electric wire, the one electric wire can be wound by the shield member to form a shielding layer.

According to the exemplary embodiments of the present invention, the folding portion of the metal layer comes in contact with the non-folding portion of the metal layer in the overlapping portion. Accordingly, by the metal layer, the conduction can be ensured over the entire outer circumference of the signal wire. Accordingly, the shield performance by the shield member can be effectively achieved. Moreover, the shield member is formed only by folding one side end portion. Accordingly, with the simple structure, the shield performance can be effectively achieved. Moreover, as compared to the case that the shield member is doubly wound onto the signal wire, the amount used for the shield member can be reduced. Accordingly, the cost can be reduced. Further, the width of the cable can be reduced, and the wiring performance can be increased.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

The invention claimed is:

1. A shielded cable comprising:

at least one electric wire; and a shielding layer covering the at least one electric wire, which is formed by helically winding a tape-shaped shield member, wherein the shielding layer is formed by winding the tape-shaped shield member laminating and integrating an insulating layer and a metal layer such that one side end portions along a lengthwise direction overlap with each other to form an overlapping portion and a non-overlapping portion of the tape-shaped shield member, wherein a first one side end portion of the tape-shaped shield member forming the overlapping portion is a folding portion formed by folding the insulating layer inward, and a second one side end portion forming the non-overlapping portion is a non-folding portion that is not folded, wherein, in the overlapping portion, the metal layer at the folding portion and the metal layer at the non-folding portion are electrically connected with each other, and wherein the shielding layer has a plurality of notches formed at a distance along the second one side end portion of the tape-shaped shield member, so that a direction of each notch coincides with a direction of an axis of the cable.

2. The shielded cable according to claim 1, wherein the metal layer at the folding portion and the metal layer at the non-folding portion are bonded with a conductive adhesive.

3. The shielded cable according to claim 1, wherein an outer surface of the shielding layer is covered with a heat-shrinkable insulating member.

4. The shielded cable according to claim 1, further comprising a drain wire being in contact with the metal layer.

* * * * *